United States Patent [19]

Puhak

[11] 4,151,441

[45] Apr. 24, 1979

[54] CATHODE SUPPORT MEANS IN ELECTRON GUN STRUCTURE OF A CATHODE RAY TUBE

[75] Inventor: Peter G. Puhak, Seneca Falls, N.Y.

[73] Assignee: GTE Sylvania Incorporated, Stamford, Conn.

[21] Appl. No.: 905,064

[22] Filed: May 11, 1978

[51] Int. Cl.[2] ..... H01J 29/04; H01J 29/50; H01J 29/82

[52] U.S. Cl. ..... 313/446; 313/417; 313/457

[58] Field of Search ..... 313/417, 446, 457, 456

[56] References Cited

U.S. PATENT DOCUMENTS

| | | | |
|---|---|---|---|
| 3,973,162 | 8/1976 | Collins | 313/446 X |
| 3,974,416 | 8/1976 | van der Goot et al. | 313/417 |
| 4,044,278 | 8/1977 | Jariwala | 313/417 |
| 4,071,803 | 1/1978 | Takanashi et al. | 313/446 X |

*Primary Examiner*—Palmer C. Demeo
*Attorney, Agent, or Firm*—William H. McNeill

[57] ABSTRACT

Improved means are provided for supporting a thermionic cathode in a cathode ray tube electron gun structure. A dual-leg configurated wire component, evidencing minimal mass and low heat sink characteristics, is utilized to provide positive support for the cathode and promote rapid cathode warmup.

7 Claims, 7 Drawing Figures

CATHODE SUPPORT MEANS IN ELECTRON GUN STRUCTURE OF A CATHODE RAY TUBE

BACKGROUND OF THE INVENTION

This invention relates to cathode ray tube electron gun structures and more particularly to improved means for supporting the cathodes utilized therein.

In present day television equipment utilizing thermionic electron emission devices, the time required for cathode warm-up has long been recognized as an important factor in determining the span of time between equipment turn-on and operational response. The substantially instantaneous activation of solid state circuitry has made the warm-up time required of the cathode ray tube (CRT) thermionic cathode means a major deterrent to the achieving of a rapid operational state. Such CRT cathodes are conventionally cylindrical sleeves having closed ends whereupon electron emissive material is terminally disposed. Heating elements encompassed within the sleeves provide the thermal energy necessary to achieve electron emission.

These cathode elements have been supported within the electron gun structure in several ways, i.e., by crimping or otherwise affixing the sleeve within an apertured supporting ceramic, or by several adaptations of metallic cylindrical members or eyelets wherein the cathode sleeve is substantially encompassed and positionally affixed. Such supportive means have all evidenced appreciable conductive contact with the cathode sleeve thereby producing undesirable heat sink characteristics, which relate directly to the length of the pre-operational time span.

OBJECTS AND SUMMARY OF THE INVENTION

Accordingly, it is an object of the invention to reduce and obviate the aforementioned disadvantages evidenced in the prior art.

It is another object of this invention to provide support means for a cathode in a CRT electron gun structure that evidences minimal heat sink characteristics.

A further object of the invention is the provision of cathode support means that, while having minimal mass, has features promoting facile positional alignment in the gun structure.

These and other objects and advantages are achieved in one aspect of the invention wherein a thermionic cathode is supported in a CRT electron gun structure by a clip-like means. Substantially, this cathode supportive means is formed of a folded length of wire to provide a dual leg component having a closed end, an open end and a pair of intermediate sections wherebetween the rearward portion of the cathode is affixed in a manner substantially normal thereto. This cathode support clip has the respective end portions thereof configurated to seat on and be attached to spaced apart parallel walls of a formed cathode positioning member which is part of the gun structure. The cathode, being spatially oriented between the parallel walls of the positioning member, is supported in a manner whereby the forward end thereof projects through an accommodating opening in the member to the proximity of the control electrode element of the gun structure.

DESCRIPTION OF THE PREFERRED EMBODIMENT

For a better understanding of the present invention, together with other and further objects, advantages, and capabilities thereof, reference is made to the following specification and appended claims in connection with the above-described drawings.

Figure 1:
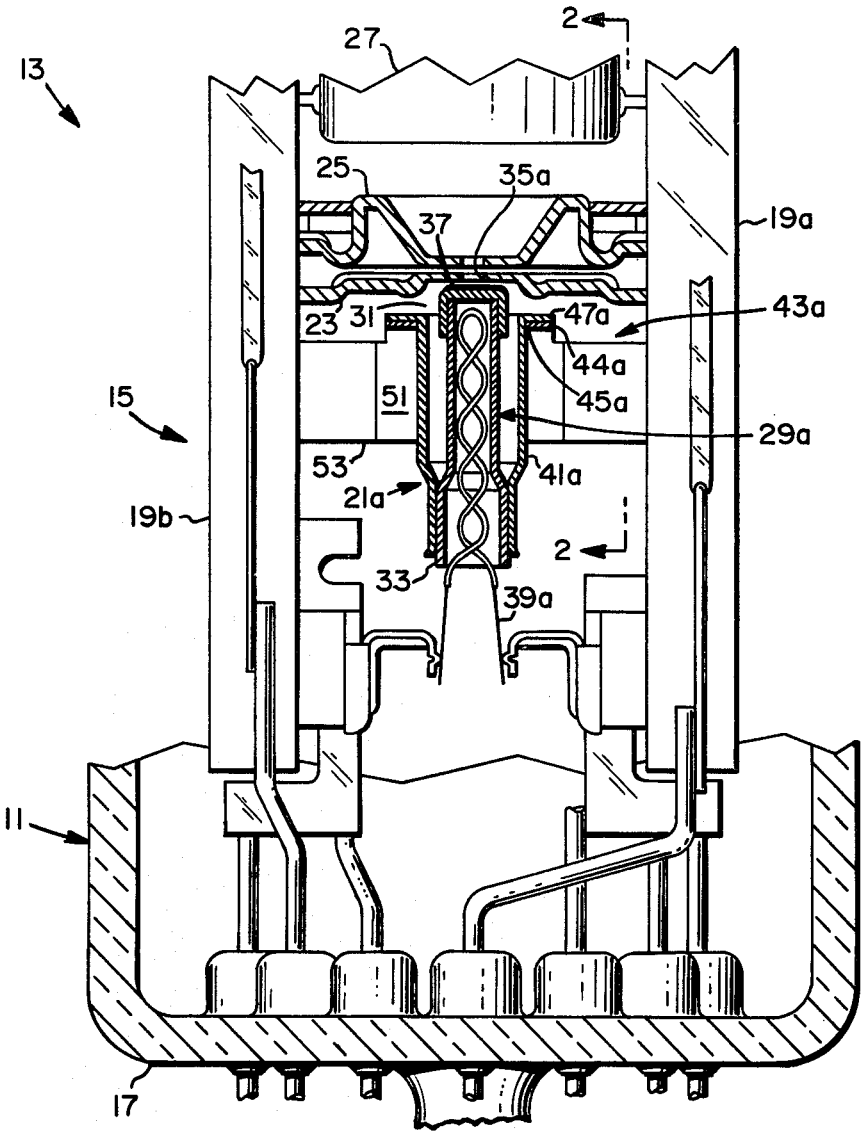
Fig. 1 PRIOR ART
FIG. 1 is an elevational view illustrating a section of the closure region of the neck portion of a CRT wherein a prior art embodiment of a cathode support means is shown in cross-section as part of the partially detailed electron gun structure positioned within the neck.
Figure 2:
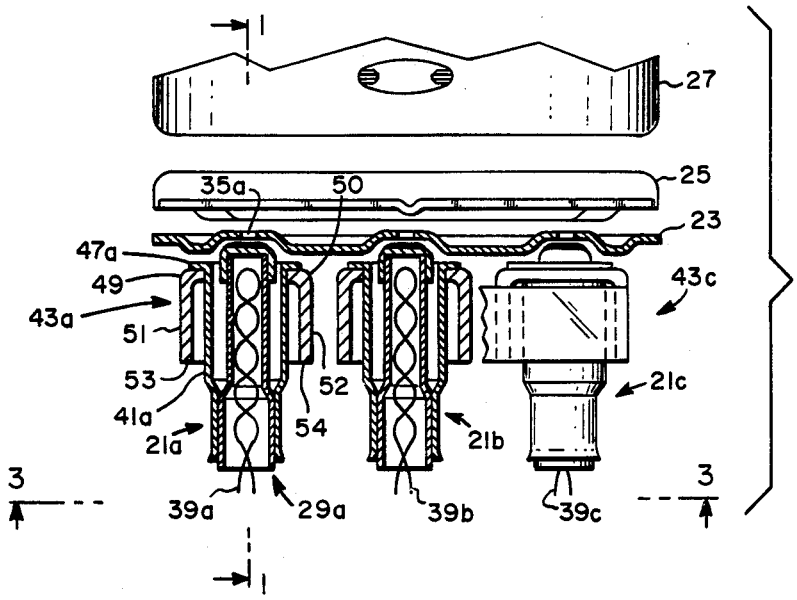
Fig. 2 PRIOR ART
FIG. 2 is another elevation further detailing the prior art as taken along the line 2—2 of FIG. 1.
Figure 3:
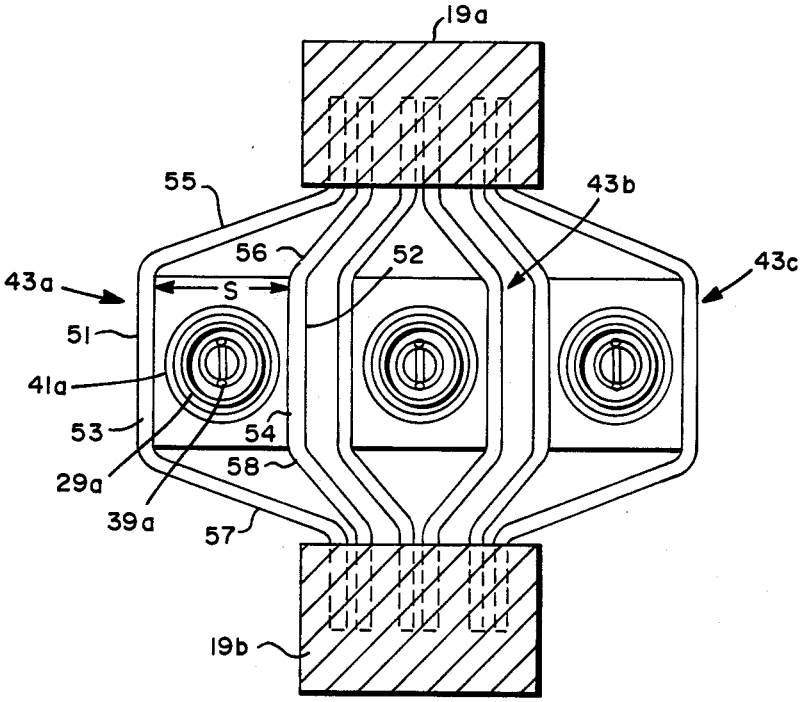
Fig. 3 PRIOR ART
Fig. 3 is a prior art plan view taken along the line 3—3 of FIG. 2.
Figure 4:
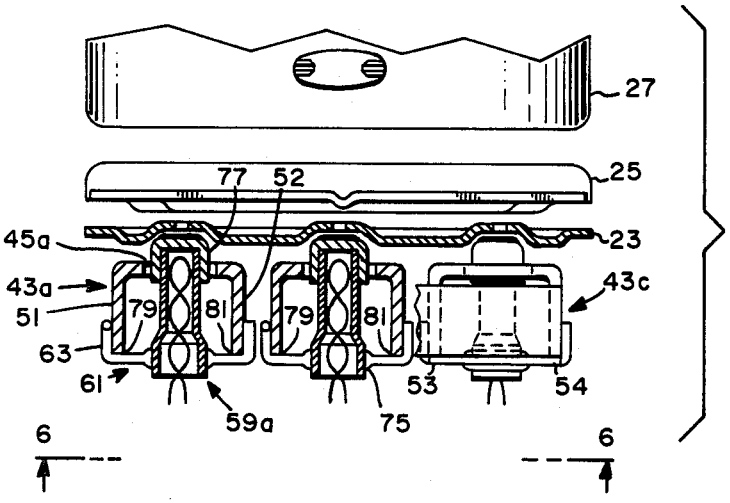
FIG. 4 is an elevational view wherein the cathode supportive means of the invention are illustrated.
Figure 5A:
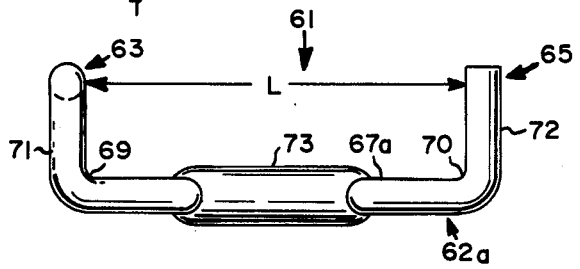
FIGS. 5A and 5B are enlarged elevational and plan views respectively detailing the structural aspects of the invention.
Figure 5B:
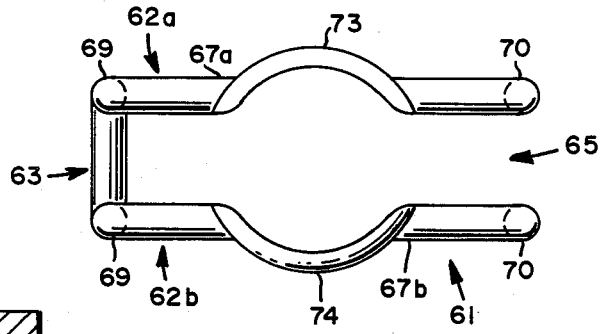
Figure 6:
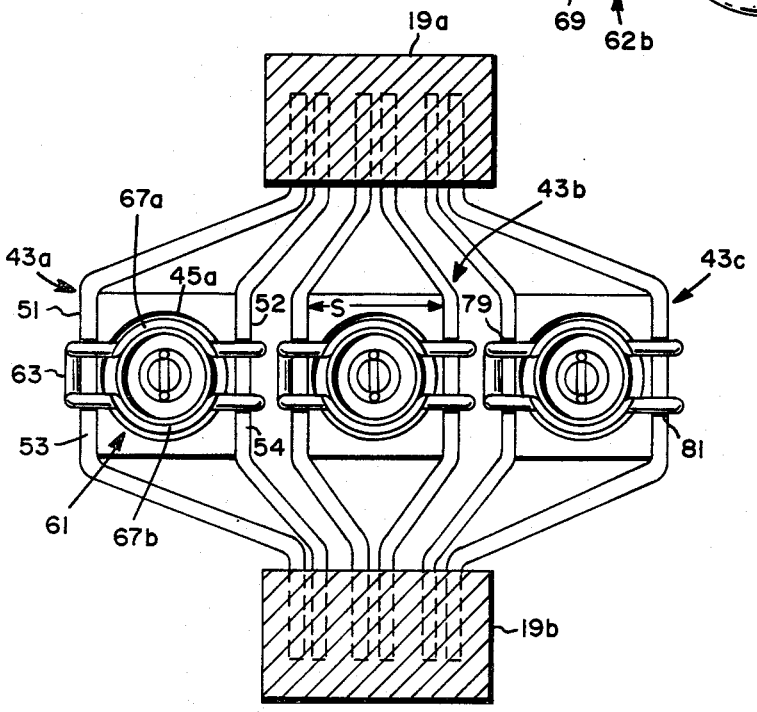
FIG. 6 is a plan view further illustrating the invention as taken along the line 6—6 of FIG. 4.

With reference to the drawings, there is shown in prior art FIGS. 1, 2 and 3 a section of the envelope neck portion 11 of a cathode ray tube 13 wherein the electron gun assembly 15 is accommodated, such being structurally supported from the integral neck closure portion 17. While the invention, to be subsequently described, is applicable to either single or multi-gun structures, in this instance a multi-gun assembly is delineated, such being the type conventionally employed in color television applications. To promote clarity, certain irrelevant supportive and connective elements have been eliminated in the drawings. Each individual gun of the plural-gun inline assembly 15 is composed of a plurality of aligned electrodes integrated into the gun structure by embedment of supportive straps into at least two longitudinal rod-like insulative members 19*a* and 19*b*. The several elements of the partially illustrated exemplary gun structure 15 include similar cathode assemblies 21*a*, 21*b* and 21*c*, a common first or control electrode member 23, a common second or accelaration electrode member 25 and a third or focusing electrode member 27.

Referring in greater detail to the prior art, the thermionic cathode assembly 21*a*, for example, is comprised of a cathode sleeve 29*a* having a closed forward end 31 and an open rearward end 33. The forward end 31, being proximal to a respective aperture 35*a* in the control electrode 23, has heat responsive electron emissive material 37 terminally disposed thereon. A heater element 39*a* is positioned within the cathode sleeve 29*a* to provide the temperature necessary for achieving electron emission. As shown, the cathode sleeve is surrounded and supported by a shielding eyelet 41*a*, attachment being made to the rearward area of the cathode.

The eyelet is supported in a cathode positioning member 43*a* having a substantially planar base section 44*a* wherein a substantially central opening 45*a* is formed. This opening, which is of a size larger than the cross-sectional dimension of the eyelet, accommodates placement of the eyelet therein with the annular flange 47*a* of the eyelet being seated upon and affixed to the planar section 44*a* of the positioning member 43*a*.

Each of the cathode positioning members 43*a*, 43*b* and 43*c* is formed in a related manner in keeping with its position in the multigun structure. For example, in member 43*a*, the material forming the planar section 44*a* is continued therefrom to have two spaced apart parallel transverse bends 49 and 50, on either side of the planar section 44, wherefrom side members 51 and 52 project in a manner substantially perpendicular to the planar section. These shaped side members 51 and 52 form two parallel substantially similar skirt-like walls, each having a terminative edge, 53 and 54 respectively wherefrom a span relationship "S" is evidenced therebetween. Each of the side members or walls 51 and 52 has extending extremital portions 55, 56, and 57, 58 shaped for embedment in the respective insulative support members 19*a* and 19*b*.

In the aforedescribed cathode support means, the shielding eyelet and cathode attachment relationship evidences a considerable mass of material which constitutes a significant heat sink and thereby contributes to slower cathode warm-up.

The invention pertains to a cathode support member that employs a much reduced mass of material, which in turn lessens the heat sink characteristic and thereby promotes more rapid cathode warm-up. In describing the invention, attention is directed to FIGS. 4, 5A, 5B and 6 wherein the cathode support means of the invention utilizes the previously described cathode positioning members 43*a*, 43*b* and 43*c*. The parallel sides or skirt-like walls 51 and 52 provide shielding, for example, for cathode sleeve 59*a*, therefore the cathode shielding eyelet has been eliminated.

The unique cathode support means 61 of the invention is formed of a folded length of wire to provide a clip-like component having dual legs 62*a* and 62*b* and evidencing a closed end 63, an opposed open end 65 and a pair of intermediate portions 67*a* and 67*b* therebetween. Proximal to the respective closed and open ends 63 and 65, the support means has two parallel transverse perpendicular bends 69 and 70 formed in a common direction normal to the legs. This provides upstanding or outstanding closed and open end portions 71 and 72 which define equal lengths "L" of the intermediate leg portions 67*a*, 67*b* therebetween. This intermediate length "L" is substantially equal to the length of the span "S" separating the two spatially related parallel sidewalls 51 and 52 of the positioning member 43*a*, plus the respective wall thickness thereof. Thus, the configurated dual-leg cathode support member is dimensioned to seat on the terminative edges 53 and 54 of the parallel walls of the positioning member 43*a* and be suitably affixed thereto as by welding. Accordingly, the outstanding end portions 71 and 72 of the support member are positioned substantially contiguous with the outer surfaces of the sidewalls 51 and 52.

To adequately accommodate encompassement of the cylindrical cathode sleeve 59*a*, the intermediate sections 67*a*, 67*b* of the respective dual legs 62*a*, 62*b* of the support member 61 have concavely facing arcuate shapings 73 and 74 formed substantially centrally therein defining a circumferential arc approximating the outer circumference of the cathode sleeve at the region of affixation. As shown, swaging or partially flattening the wire material in the arcuate regions 73 and 74, to provide substantially flat surfaces for cathode affixation, also promotes improved means for cathode alignment.

The material from which the configurated cathode support member 61 is formed is preferably a round wire stock exhibiting a rigid strength sufficient to maintain positive support of the sleeve. The material should exhibit a low coefficient of linear thermal expansion and evidence a degree of stiffness or resilience. The resilience of the material is advantageous in maintaining a slight inward cant to the legs to provide a moderate inwardly directed pressure on the encompassed cathode sleeve positioned therebetween. Such pressure facilitates accurate positioning and affixation of the sleeve. With the sleeve being oriented in this manner, the forward end 77 therof is spatially accommodated within the central opening 45*a* of the cathode positioning member 43*a* in a manner to protrude therethrough to the proximity of the control electrode 23.

In each of the respective positioning members 43*a*, 43*b*, and 43*c* it has been found advantageous to form a pair of shallow recesses 79 and 81 in the parallel walls 51 and 52, inward from the terminative edges 53 and 54 thereof, to provide alignment notches for facilitating accurate and facile placement of the cathode support means 61 on the respective positioning member.

As is evident, the improved cathode support means of the invention provides minimal heat sink characteristics and therefore promotes rapid cathode warm-up. The low-mass structure of the invention enables the usage of shorter cathode sleeves along with shorter and more compact heating elements.

While there has been shown and described what are at present considered the preferred embodiments of the invention, it will be obvious to those skilled in the art that various changes and modifications may be made therein without departing from the scope of the invention as defined by the appended claims.

What is claimed is:

1. In a cathode ray tube electron gun structure integrated by a plurality of elongated rod-like members longitudinally arranged to support a plurality of spatially related electrode elements forming said structure wherein a thermionic cathode, having a closed forward end with electron emissive material disposed thereon, is positioned adjacent an apertured control electrode element, means for supporting said cathode comprising: a cathode positioning member including a substantially planar base section having a substantially central opening formed therein of a size larger than the cross-sectional dimension of said cathode, said planar section having two parallel transverse bends therein one on either side thereof wherefrom opposed side members project in a manner substantially perpendicular thereto to form two parallel substantially similar skirt like walls having terminative edges and evidencing a span relationship therebetween, each of said walls having at least one extending extremital portion shaped for embedment in said elongated integrating members; and a cathode support member formed of a folded length of wire to provide a dual-leg clip-like component having a closed end, an open end and a pair of substantially parallel intermediate portions wherebetween the rearward portion of said cathode is affixed in a manner substantially normal thereto, said component and cathode being located on and attached to the terminative edge regions of said perpendicularly related side members of said cathode positioning member to effect cathode orientation with the forward end thereof being spatially accommodated within the central opening of said cathode positioning member in a manner to protrude therethrough to the proximity of said control electrode.

2. Cathode support means according to claim 1 wherein said dual-leg support member has two parallel transverse perpendicular bends formed therein normal to said legs, said bends being proximal to the respective closed and open ends of said component thereby providing outstanding closed end and open end portions thereof with the equal lengths of the intermediate leg portions therebetween being substantially equal to the length of the span separating the two spatially related parallel walls and the respective wall thicknesses of said cathode positioning member.

3. Cathode support means according to claim 2 wherein said configurated dual-leg support member is positioned to seat on the terminative edges of said parallel walls of said positioning member and be affixed thereto, said outstanding end portions of said support member being contiguous with the outer surfaces of said walls.

4. Cathode support means according to claim 1 wherein said cathode is of substantially cylindrical cross-section and wherein the intermediate portions of the respective dual legs of said support member have concavely facing arcuate shapings substantially centrally formed therein to define a circumferential arc approximating the outer circumference of said cathode at the region of affixation.

5. Cathode support means according to claim 4 wherein said support member is formed of substantially round wire material, and wherein said material forming said arcuate shapings is swaged to provide a substantially flat surface whereupon said cathode is affixed.

6. Cathode support means according to claim 4 wherein said support member is formed of metallic material exhibiting a degree of resilience and wherein said legs are positioned to have a slight inward cant to provide a moderate pressure on said cathode thereby facilitating accurate positioning and affixation.

7. Cathode support means according to claim 1 wherein said parallel walls of said positioning member have recesses formed therein inward from said terminative edges to provide alignment notches for facilitating accurate and facile placement of said cathode support component on said positioning member.

* * * * *